US010994967B2

(12) United States Patent
Fever et al.

(10) Patent No.: US 10,994,967 B2
(45) Date of Patent: May 4, 2021

(54) INTERACTIVE TOUCH-BASED CAR OPERATING PANEL SYSTEMS FOR ELEVATOR CARS

(71) Applicant: Otis Elevator Company, Farmington, CT (US)

(72) Inventors: Michael Fever, Ouzouer sur Loire (FR); Ridouane Belhadj, Sully sur Loire (FR)

(73) Assignee: OTIS ELEVATOR COMPANY, Farmington, CT (US)

( * ) Notice: Subject to any disclaimer, the term of this patent is extended or adjusted under 35 U.S.C. 154(b) by 503 days.

(21) Appl. No.: 15/975,933

(22) Filed: May 10, 2018

(65) Prior Publication Data

US 2018/0339878 A1 Nov. 29, 2018

(30) Foreign Application Priority Data

May 23, 2017 (EP) ..... 17305608

(51) Int. Cl.
*B66B 1/50* (2006.01)
*B66B 1/46* (2006.01)
(Continued)

(52) U.S. Cl.
CPC ..... *B66B 1/50* (2013.01); *B66B 1/463* (2013.01); *B66B 1/467* (2013.01); *B66B 1/52* (2013.01);
(Continued)

(58) Field of Classification Search
CPC ... B66B 1/468; B66B 2201/463; B66B 3/006; B66B 3/008; B66B 3/002; B66B 1/3415;
(Continued)

(56) References Cited

U.S. PATENT DOCUMENTS 4,678,062 A 7/1987 Sumka
6,902,041 B2 * 6/2005 Eccleston ..... B66B 1/463 187/380
(Continued)

FOREIGN PATENT DOCUMENTS

CN 201201835 U 3/2009
CN 101830377 A 9/2010
(Continued)

OTHER PUBLICATIONS

European Search Report, European Application No. 17305608.6, dated Nov. 27, 2017, European Patent Office; European Search Report 7 pages.

*Primary Examiner* — Marlon T Fletcher
(74) *Attorney, Agent, or Firm* — Cantor Colburn LLP

(57) ABSTRACT

Elevator cars having a plurality of elevator car panels defining a passenger compartment of the elevator car and an interactive touch-based car operating panel system. The interactive touch-based car operating panel system includes an interactive element extending around at least a portion of a periphery of the passenger compartment and located on at least one of the plurality of elevator car panels, the interactive element having an interactive surface facing the passenger compartment and a controller arranged to receive passenger input at the interactive surface and control an elevator car in response to the passenger input.

20 Claims, 9 Drawing Sheets

(51) Int. Cl.
*B66B 1/52* (2006.01)
*B66B 11/02* (2006.01)
*B66B 13/30* (2006.01)

(52) U.S. Cl.
CPC ..... *B66B 11/0226* (2013.01); *B66B 13/303* (2013.01); *B66B 2201/4623* (2013.01)

(58) Field of Classification Search
CPC ..... B66B 1/24; B66B 1/3461; B66B 1/3423; B66B 1/34; B66B 1/52; B66B 11/0226; B66B 1/463; B66B 2201/4607; B66B 2201/4623; B66B 13/303; B66B 1/06; B66B 1/50; G08B 13/19682; B65G 2209/04
See application file for complete search history.

(56) References Cited

U.S. PATENT DOCUMENTS

| | | | | |
|---|---|---|---|---|
| 9,561,931 | B2 | 2/2017 | Kauppinen et al. | |
| 2006/0180407 | A1 | 8/2006 | Lee | |
| 2013/0220740 | A1 | 8/2013 | Yoo | |
| 2015/0246790 | A1 | 9/2015 | Hiltunen et al. | |
| 2017/0297865 | A1* | 10/2017 | Bruno | B66B 5/0006 |
| 2017/0355557 | A1* | 12/2017 | Witczak | B66B 9/00 |
| 2018/0099840 | A1* | 4/2018 | Armistead | B66B 3/008 |
| 2018/0282113 | A1* | 10/2018 | Simcik | B66B 1/468 |
| 2018/0287970 | A1* | 10/2018 | Baldi | H04L 51/04 |
| 2018/0339878 | A1* | 11/2018 | Fever | B66B 1/52 |
| 2018/0346282 | A1* | 12/2018 | Simcik | H04W 4/023 |
| 2018/0354746 | A1* | 12/2018 | Blanchard | B66B 1/461 |
| 2019/0241398 | A1* | 8/2019 | Marvin | B66B 1/28 |

FOREIGN PATENT DOCUMENTS

| | | | |
|---|---|---|---|
| CN | 201793299 | U | 4/2011 |
| CN | 102285562 | A | 12/2011 |
| CN | 202729491 | U | 2/2013 |
| CN | 202744124 | U | 2/2013 |
| CN | 203345870 | U | 12/2013 |
| CN | 101992979 | B | 1/2014 |
| CN | 104444662 | A | 3/2015 |
| CN | 104925599 | A | 9/2015 |
| CN | 204873361 | U | 12/2015 |
| JP | S61263576 | A1 | 11/1986 |
| JP | H06171851 | A | 6/1994 |
| JP | 2000226162 | A | 8/2000 |
| JP | 2004277119 | | 10/2004 |
| JP | 2010208754 | A | 9/2010 |
| JP | 2011051719 | A | 3/2011 |
| JP | 2015229548 | | 12/2015 |
| WO | 2015034191 | A1 | 3/2015 |
| WO | 2016124810 | A1 | 8/2016 |

* cited by examiner

INTERACTIVE TOUCH-BASED CAR OPERATING PANEL SYSTEMS FOR ELEVATOR CARS

CROSS-REFERENCE TO RELATED APPLICATIONS

This application claims the benefit of European Application No. 17305608.6, filed May 23, 2017, which is incorporated herein by reference in its entirety.

BACKGROUND

The subject matter disclosed herein generally relates to car operating panels of elevator systems and, more particularly, to easy-access car operating panels for elevator systems.

Elevator systems, and particularly elevator cars, include car operating panels that are accessible by passengers to indicate a desired destination. In order for a passenger to indicate a desired floor, the passenger must access the car operating panel and interact with various buttons, inputs, or other device or functions. However, when the elevator car is crowded, access to the car operating panel may be difficult or hampered, and thus a passenger may not be able to input a desired destination after entering the elevator car. Accordingly, it may be advantageous to provide easier access for passengers to input desired destination information into an elevator system.

SUMMARY

According to some embodiments, elevator cars are provided. The elevator cars include a plurality of elevator car panels defining a passenger compartment of the elevator car and an interactive touch-based car operating panel system. The interactive touch-based car operating panel system has an interactive element extending around at least a portion of a periphery of the passenger compartment and located on at least one of the plurality of elevator car panels, the interactive element having an interactive surface facing the passenger compartment and a controller arranged to receive passenger input at the interactive surface and control an elevator car in response to the passenger input.

In addition to one or more of the features described above, or as an alternative, further embodiments of the elevator car may include that the interactive surface is divided into a plurality of input regions, wherein each input region provides a different function.

In addition to one or more of the features described above, or as an alternative, further embodiments of the elevator car may include that the plurality of input regions comprise a first input region and a second input region, wherein the first input region is located relative higher in the elevator car than the second input region and the first input region provides a functionality to request a destination floor above a current floor of the elevator car and the second input region provides a functionality to request a destination floor below a current floor of the elevator car.

In addition to one or more of the features described above, or as an alternative, further embodiments of the elevator car may include that the plurality of input regions includes a confirmation region enabling confirmation or cancelation of the passenger input.

In addition to one or more of the features described above, or as an alternative, further embodiments of the elevator car may include that the interactive surface is a display arranged to display interactive elements thereon.

In addition to one or more of the features described above, or as an alternative, further embodiments of the elevator car may include that the interactive surface includes a quick access element to enable selection of a predetermined destination.

In addition to one or more of the features described above, or as an alternative, further embodiments of the elevator car may include that the elevator car further includes an elevator car door in at least one elevator car panel, wherein the interactive element extends about an entire periphery of the passenger compartment except for where the elevator car door is located.

In addition to one or more of the features described above, or as an alternative, further embodiments of the elevator car may include that the interactive touch-based car operating panel system further includes an information panel located within the elevator car and controllable to display information related to the passenger input.

In addition to one or more of the features described above, or as an alternative, further embodiments of the elevator car may include a primary car operating panel installed in one of the elevator car panels.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

DETAILED DESCRIPTION

Figure 1:
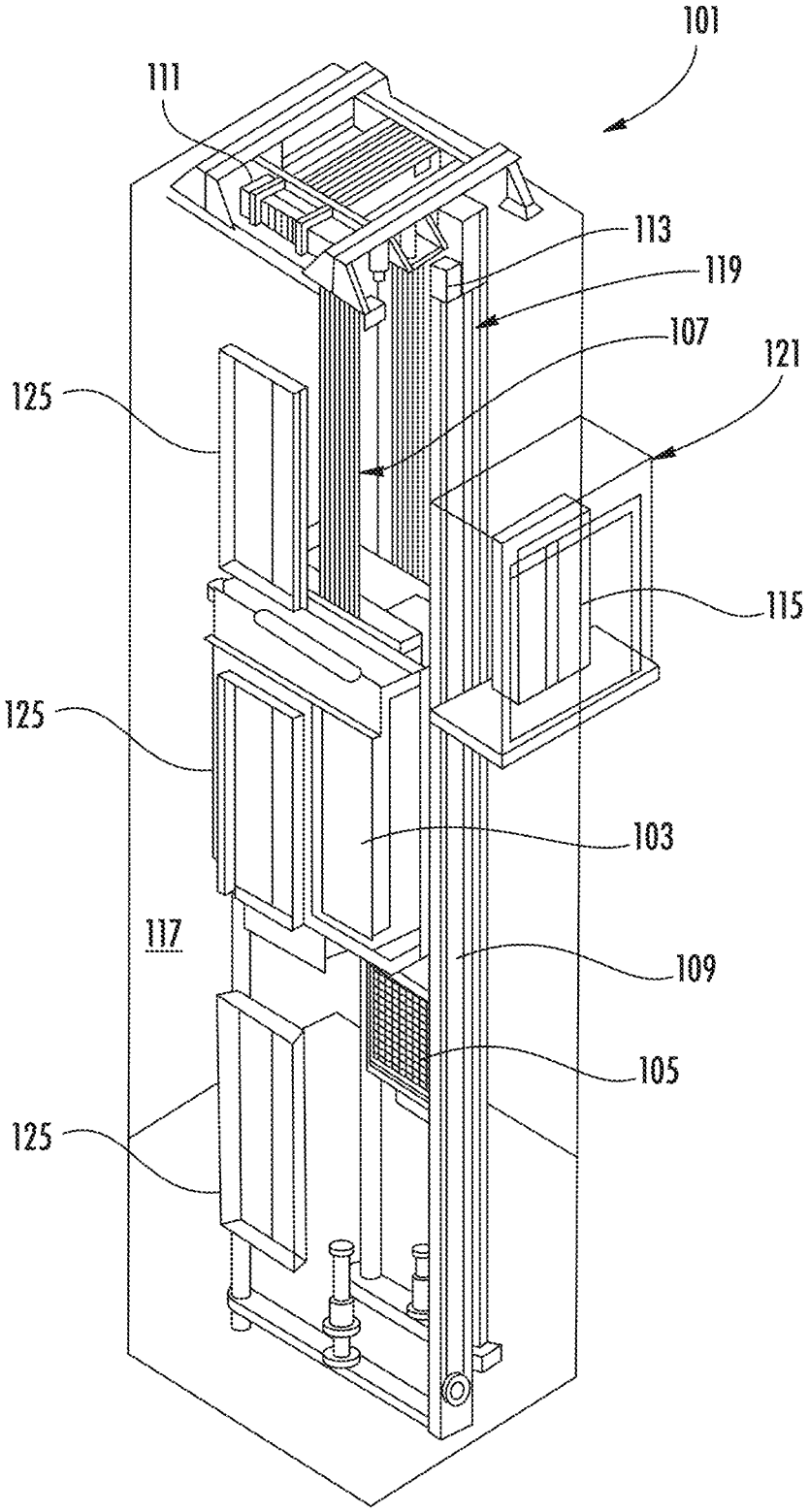
FIG. 1 is a schematic illustration of an elevator system that may employ various embodiments of the present disclosure.

FIG. 1 is a schematic illustration of an elevator system that may employ various embodiments of the present disclosure. FIG. 1 is a perspective view of an elevator system 101 including an elevator car 103, a counterweight 105, a roping 107, a guide rail 109, a machine 111, a position encoder 113, and a controller 115. The elevator car 103 and counterweight 105 are connected to each other by the roping 107. The roping 107 may include or be configured as, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator shaft 117 and along the guide rail 109.

The roping 107 engages the machine 111, which is part of an overhead structure of the elevator system 101. The machine 111 is configured to control movement between the elevator car 103 and the counterweight 105. The position encoder 113 may be mounted on an upper sheave of a speed-governor system 119 and may be configured to provide position signals related to a position of the elevator car 103 within the elevator shaft 117. In other embodiments, the position encoder 113 may be directly mounted to a moving component of the machine 111, or may be located in other positions and/or configurations as known in the art.

The controller 115 is located, as shown, in a controller room 121 of the elevator shaft 117 and is configured to control the operation of the elevator system 101, and particularly the elevator car 103. For example, the controller 115 may provide drive signals to the machine 111 to control the acceleration, deceleration, leveling, stopping, etc. of the elevator car 103. The controller 115 may also be configured to receive position signals from the position encoder 113. When moving up or down within the elevator shaft 117 along guide rail 109, the elevator car 103 may stop at one or more landings 125 as controlled by the controller 115. Although shown in a controller room 121, those of skill in the art will appreciate that the controller 115 can be located and/or configured in other locations or positions within the elevator system 101.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor.

Although shown and described with a roping system, elevator systems that employ other methods and mechanisms of moving an elevator car within an elevator shaft may employ embodiments of the present disclosure. FIG. 1 is merely a non-limiting example presented for illustrative and explanatory purposes.

Figure 2A:
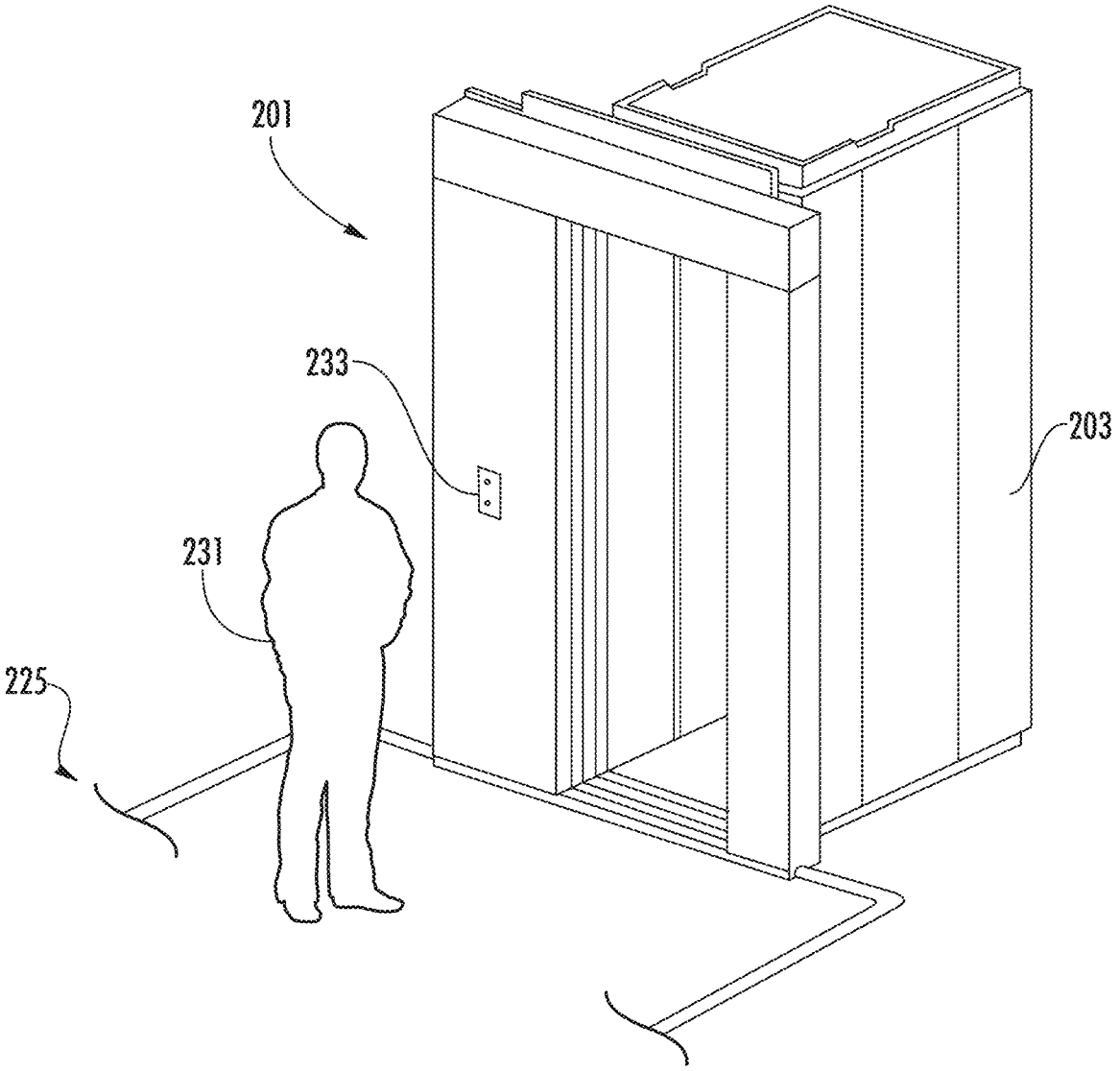
FIG. 2A is a schematic illustration of an elevator system having an elevator car that may incorporate features of the present disclosure.
Figure 2C:
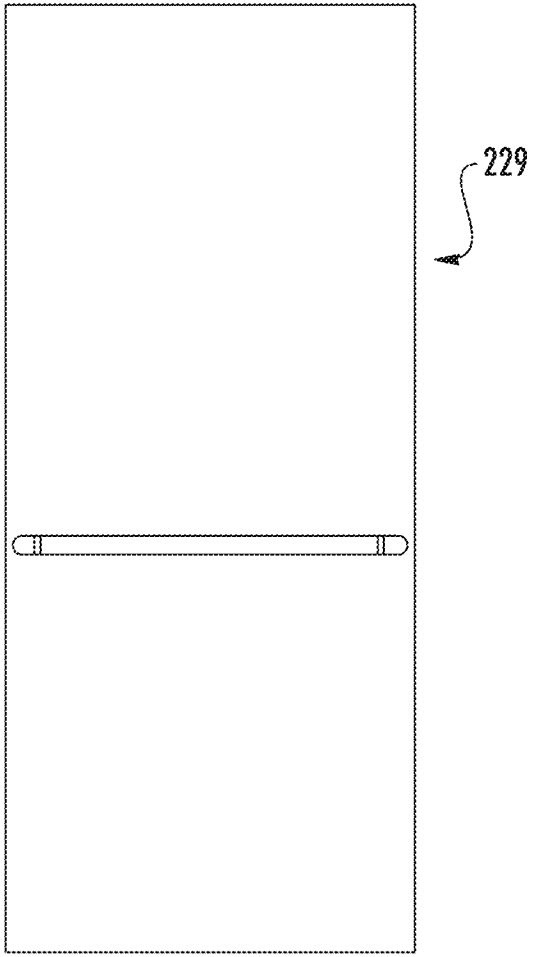
FIG. 2C is a front elevation schematic view of a second elevator car panel of the elevator car of FIG. 2A.
Figure 2B:
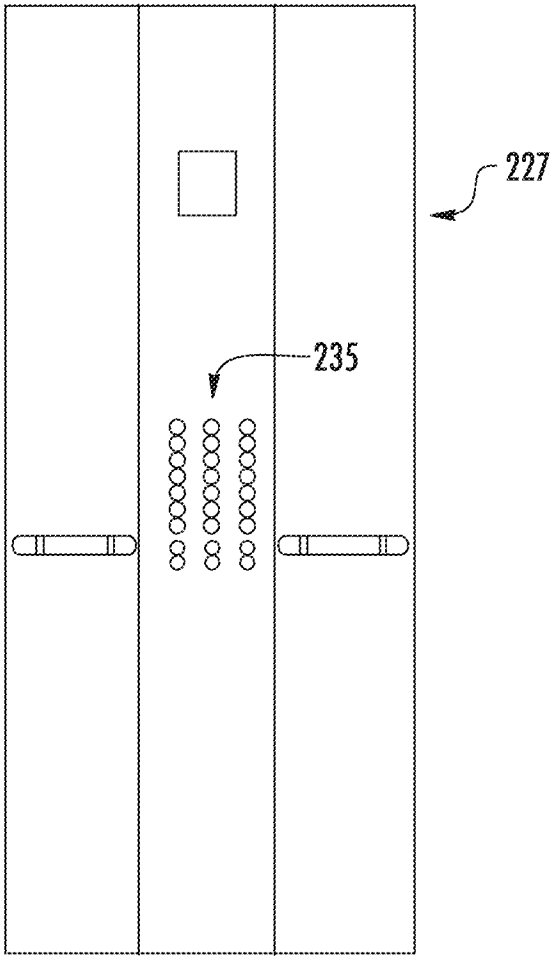
FIG. 2B is a front elevation schematic view of a first elevator car panel of the elevator car of FIG. 2A.

Turning to FIGS. 2A-2C, schematic illustrations of an elevator system 201 having an elevator car 203 with elevator car panels 227, 229 that can employ embodiments described herein are shown. FIG. 2A is a schematic illustration of the elevator system 201 and elevator car 203 as viewed from a landing 225. FIG. 2B shows a front elevation schematic view of a first elevator car panel 227 of the elevator car 203. FIG. 2C shows a front elevation schematic view of a second elevator car panel 229 of the elevator car 203. A passenger 231 may call the elevator car using a hall call panel 233. Upon arrival of the elevator car 203 at the landing 225, the passenger 231 may enter the elevator car 203 and attempt to access or reach a car operating panel 235 to select a desired destination floor. Elevator cars typically include one or maybe two car operating panels 235 depending on the configuration of the elevator car 203. For example, in some configurations, the first elevator car panel 227 may represent a portion of the elevator car 203 that is next to an elevator door, and thus one car operating panel 235 may be located on either side of the elevator door. However, as shown, the second elevator car panel 229, which may represent all elevator car panels that do not include the elevator car door, does not include a car operating panel. As such, when the passenger 231 enters the elevator car 203, the passenger 231 may have to interfere with other passengers in order to reach the car operating panel 235. This is particularly true in a full or busy elevator car with a high number of occupants. Accordingly, it may be advantageous to provide a car operating panel that is accessible in multiple locations and/or from any location within the elevator car.

Figure 3:
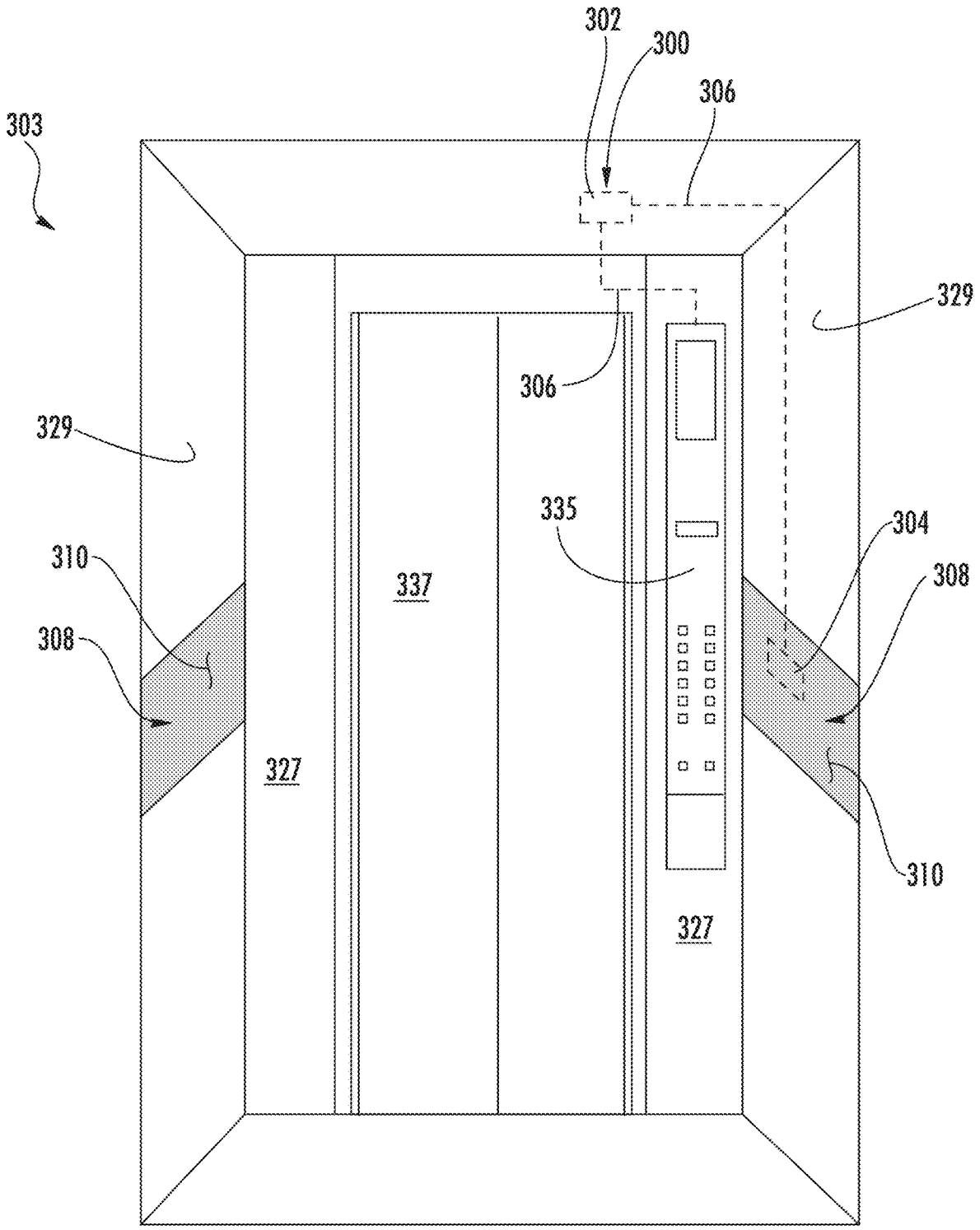
FIG. 3 is a perspective view of the inside of an elevator car equipped with an interactive touch-based car operating panel system in accordance with an embodiment of the present disclosure.

Turning now to FIG. 3, a perspective view of the inside of an elevator car 303 equipped with an interactive touch-based car operating panel system 300 in accordance with a non-limiting embodiment of the present disclosure is shown. As shown in FIG. 3, the elevator car 303 includes a first elevator car panel 327 having a car operating panel 335, the first elevator car panel 327 defining a portion of a frame about an elevator car door 337. The elevator car 303 also includes multiple second elevator car panels 329. The elevator car panels 327, 329 define interior walls of the elevator car 303 and enclose a passenger compartment of the elevator car 303.

As shown, the car operating panel 335 is located on the first elevator car panel 327 near the elevator doors 337. The car operating panel 335 is an electro-mechanical operating panel that includes buttons, touch-sensors, key pads, locks, displays, etc. as will be appreciated by those of skill in the art. The car operating panel 335 is fixed in place and physically located at a specific location within the elevator car 303. However, as noted above, the location of the car operating panel 335 may be difficult to reach for some passengers, particularly when the elevator car 303 is crowded.

In the embodiment of FIG. 3, the elevator car 303 is configured with an interactive touch-based car operating panel system 300 in accordance with an embodiment of the present disclosure. The interactive touch-based car operating panel system 300 is a touch and/or interactive system that enables passengers to perform car operating panel functions from most locations within the elevator car. That is, the interactive touch-based car operating panel system 300 is configured to provide a car operating panel in proximity to any and/or all passengers such that the passenger(s) have easy access to a car operating panel and thus can conveniently control the elevator car 303 without the need to interfere with other passengers.

The interactive touch-based car operating panel system 300 includes a first controller 302 and a second controller 304, as schematically shown. The first controller 302 is operably connected to the car operating panel 335 by a communication connection 306, and the first controller 302 and the second controller 304 are operably connected by the communication connection 306. The communication connection 306 may be a wired and/or wireless communication connection. Further, although shown and described with first and second controllers 302, 304, those of skill in the art will appreciate that in some embodiments, the first and second controllers 302, 304 can be a single controller unit. The first and second controllers 302, 304 include various electronic components including processors, memory, buses, communication elements, input/output elements, etc. to enable embodiments of the present disclosure, as will be apparent to those of skill in the art.

The interactive touch-based car operating panel system 300 further includes an interactive element 308. The interactive element 308 is a touch-based element (e.g., passenger interactive element) that is installed on one or more of the elevator car panels 327, 329. The interactive element 308 includes an interactive surface 310 that faces an interior of the elevator car 303 to enable passengers to see the interactive surface 310 and any information displayed thereon. The interactive element 308, as shown in FIG. 3, is installed on the second elevator car panels 329 and the car operating panel 335 is installed on the first elevator car panel 327. The interactive element 308 is controlled by the second controller 304, with input received at the interactive element 308 (e.g., on interactive surface 310) being processed by the second controller 304 and transmitted to the first controller 302 over the communication connection 306 and the second controller 304 configured to control the interactive element 308 to display various images and/or light up elements to provide output on the interactive element 308. In the present embodiment the car operating panel 335 may be referred to as a "primary car operating panel" and the interactive element 308 is a "secondary car operating panel" with both car operating panels enabling similar functionality to control the elevator car 303.

The interactive element 308 is installed to the second elevator car panels 329 or may be integrally formed therewith. For example, in some embodiments, the interactive element 308 can be a retroactive applied element to existing elevator car panels, and in other embodiments, the interactive element 308 may be manufactured along with the construction and/or assembly of the elevator car panels. Further, in other embodiments, the interactive element 308 can be installed as a structural element between upper and lower portions of the elevator car panel, as described herein.

The interactive surface 310 is a touch or pressure sensitive element (e.g., band, ribbon, etc.) that is able to receive input by a passenger pressing against the interactive surface 310. In some embodiments, as described herein, the interactive surface 310 can include display features such as screens, images, light-up elements, etc. Further, the interactive surface 310 can include various labeling to provide information to passengers within the elevator car. Alternatively, or in combination therewith, various instructions and/or information and labeling can be provided on the elevator car panels 327, 329, such as proximate the interactive surface 310.

Input from a passenger on the interactive surface 310 is processed by the second controller 304. The second controller 304 will then transmit a control signal to the first controller 302 and/or an elevator controller (e.g., elevator controller 115 shown in FIG. 1). In some embodiments, the second controller 304 can send a signal to the first controller 302, which can then control elements of the car operating panel 335 to light up or otherwise indicate input that has been received at the interactive surface 310. In some embodiments, the car operating panel 335 is configured to interpret input received at the interactive surface 310 as an input at the car operating panel 335 (e.g., similar to an input at a physical or mechanical button) such that an appropriate floor button lights up as "selected" to indicate to other passengers that a particular floor has been selected and the elevator car will travel to and stop at the indicated floor.

In accordance with some embodiments of the present disclosure, the interactive surface 310 is a tactile screen, divided into one or more input regions/screens. In one illustrative example, the interactive surface 310 can be divided into a plurality of input regions having a predefined vertical height that is a portion of a vertical extent of the entire interactive surface 310. In one non-limiting example, an interactive element may be arranged with two input regions that define the interactive surface, with each input region having a vertical extent of about 100 mm (about 4 inches) and the interactive surface having a total vertical extent of about 200 mm (about 8 inches). Those of skill in the art will appreciate that the vertical extent of the interactive element 308 and/or the input regions could be any size and may be adjusted based on a size of a passenger area within an elevator car and/or based on a height of the elevator car.

In various embodiments, such as that described herein, the interactive surface may be a screen that is flush with the upper and lower panels (e.g., elevator car panels 327, 329). Further, the controller for the interactive element 308 (e.g., first and/or second controllers 302, 304) may be located behind the interactive surface. As shown in FIG. 3, the interactive element 308 is located on the second elevator car panels 329 but is not located on the first elevator car panel 327. However, in some embodiments, the smart headband can be located on all panels of an elevator car.

Figure 4:
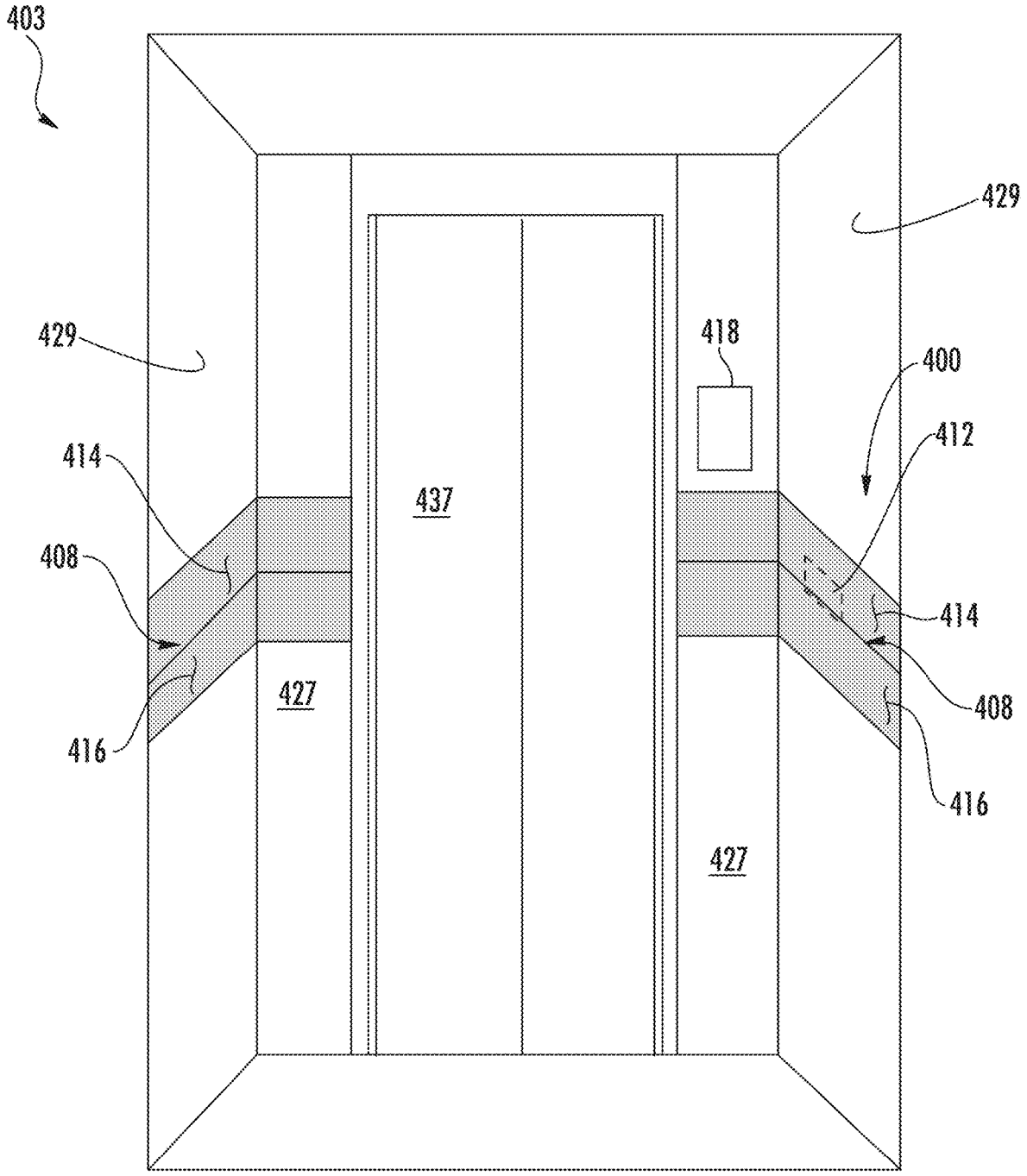
FIG. 4 is a perspective view of the inside of an elevator car equipped with an interactive touch-based car operating panel system in accordance with an embodiment of the present disclosure.

Turning now to FIG. 4, a perspective view of the inside of an elevator car 403 equipped with an interactive touch-based car operating panel system 400 in accordance with a non-limiting embodiment of the present disclosure is shown. In functionality, the interactive touch-based car operating panel system 400 is substantially similar to that shown and described above with respect to the embodiment of FIG. 3. The interactive touch-based car operating panel system 400 includes a single controller 412 that is positioned behind a portion of an interactive element 408, or can be installed behind a portion of a first or second panel 427, 429. As shown, the interactive touch-based car operating panel system 400 has an interactive element 408 that is divided into a first input region 414 and a second input region 416. In this embodiment, the first input region 414 is positioned above the second input region 416, and the first and second input regions are part of an interactive surface of the interactive touch-based car operating panel system 400. The interactive element 408 can extend around an entire periphery of the elevator car 403 (e.g., located on all panels defining a passenger compartment) or may be located on some sub-portion of the entire periphery, e.g., one or more panels or portions of panels.

In this embodiment, the first input region 414 can provide a different functionality than the second input region 416. For example, interacting with the first input region 414 can enable a passenger to request the elevator car 403 to travel upward to floors above the current landing. In contrast, the second input region 416 can enable a passenger to request downward movement of the elevator car 403. In some embodiments, the first and second input regions 414, 416 can be discrete or separate structures and in other embodiments the first and second input regions 414, 416 can be electronically separate sections of a continuous element. Further, in some embodiments, the first and second input regions 414, 416 can be defined by software that is part of the controller 412. That is, the controller 412 can receive input information at any location on the interactive element 408 and convert that input information into an input at one of the first or second input regions 414, 416 (e.g., by mapping, etc.).

Also shown in FIG. 4, the traditional, primary car operating panel has been eliminated and is no longer positioned on the first elevator car panel 427 next to an elevator door 437. In this embodiment, the interactive touch-based car operating panel system 400 provides all functionality of the traditional car operating panel. However, in some such embodiments, various elements may remain on an elevator car panel 427, 429. Such elements may include emergency and/or maintenance buttons, switches, locks, etc.

Further, in the embodiment of FIG. 4, an optional information panel 418 is located at the position of the traditional car operating panel. The information panel 418 can be operably connected to the controller 412. The information panel 418 can be a display or screen that can provide information to a passenger within the elevator car 403. In other embodiments, the information panel 418 can be a static or permanent element, such as a plaque, sign, etc. In systems including the information panel 418, when a passenger enters the elevator car, the information panel 418 can switch on and provide instructions. In some embodiments, various compulsory and/or required buttons/features (e.g., alarm button(s), door open button(s), emergency call/intercom features, etc.) may be included on the information panel 418 and/or otherwise located on elevator car panels, as will be appreciated by those of skill in the art. At the same time, the interactive surfaces (e.g., input regions 414, 416) can display various instructions, such as "Touch the band" scrolled all around the periphery of the interior of the elevator car 403. The display process can take any format and is not limited to scrolling embodiments and the displayed text and/or images can be customized to the particular desired application. Those of skill in the art will appreciate that the controller of the interactive touch-based car operating panel systems of the present disclosure can be customizable and/or programmable.

In some embodiments, the information panel 418 can be a display that indicates the current floor and any requested destinations that have been made so that passengers can visually see what floors have been requested. The information panel 418 may provide other information such as weather, news, etc. as will be appreciated by those of skill in the art.

Figure 5:
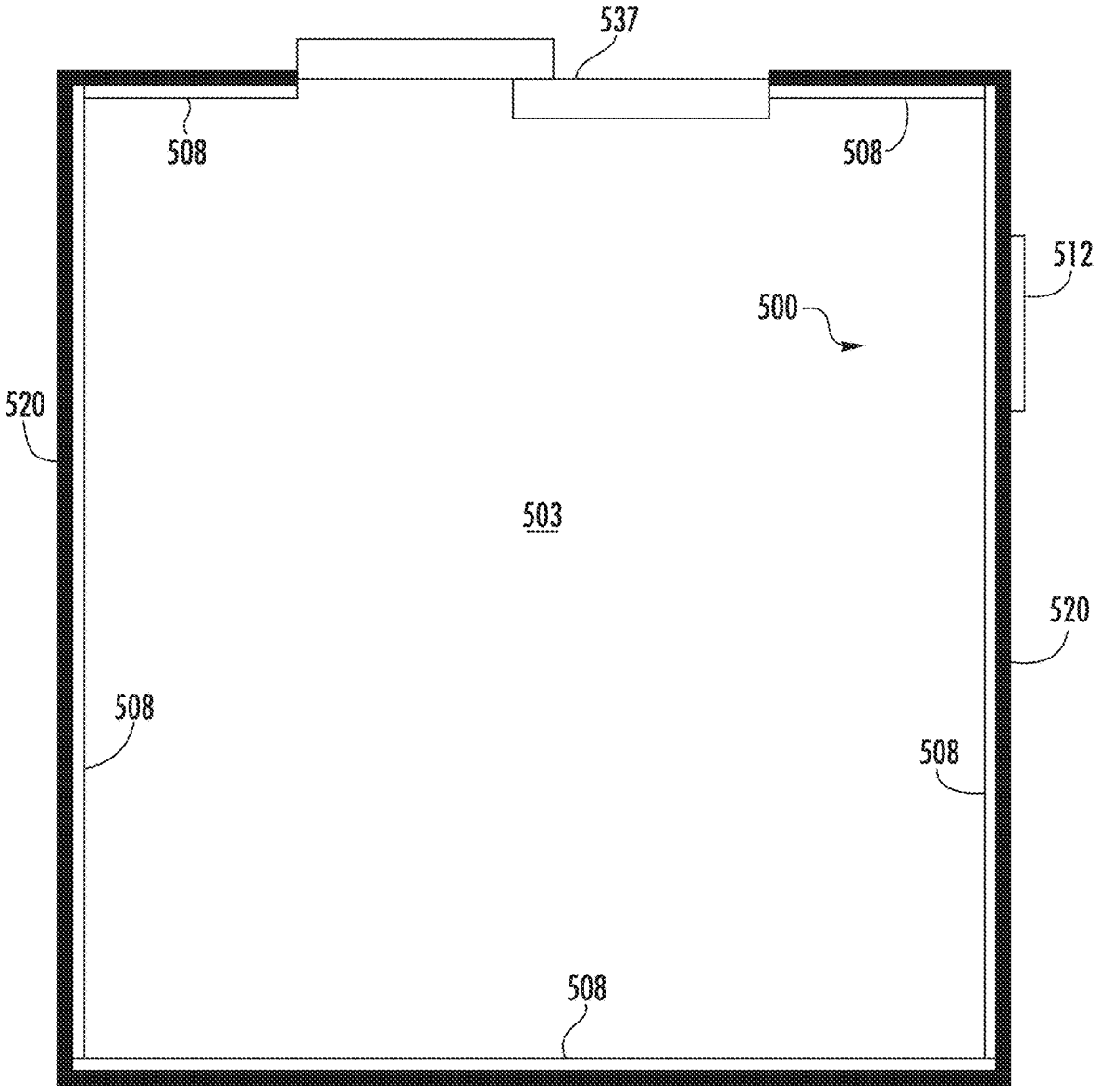
FIG. 5 is a top down plan illustration of an elevator car equipped with an interactive touch-based car operating panel system in accordance with an embodiment of the present disclosure.

Turning now to FIG. 5, a top down plan illustration of an elevator car 503 equipped with an interactive touch-based car operating panel system 500 in accordance with an embodiment of the present disclosure is shown. The interactive touch-based car operating panel system 500 is similar to the systems shown and described above and thus similar features will not be described again. As shown in FIG. 5, the elevator car 503 has walls 520 that define the structure and shape of the elevator car 503. The walls 520 can be frame elements or a structure to which elevator car panels and portions of the interactive touch-based car operating panel system 500 may be installed or otherwise attached. The interactive touch-based car operating panel system 500 of FIG. 5 includes an interactive element 508 that is installed about a periphery of the elevator car 503 on an interior of the walls 520. Further, as shown, a controller 512 can be mounted to or attached to an opposing side of the walls 520 (e.g., an exterior of the elevator car 503) or may be installed between the interactive element 508/elevator car panels and the walls 520. In the embodiment of FIG. 5, the interactive element 508 is installed on the entire periphery of the interior of the elevator car 503, except for where an elevator door 537 is located. In other embodiments, the interactive element may be installed over less than the entire periphery (e.g., as shown in FIG. 3).

Figure 6:
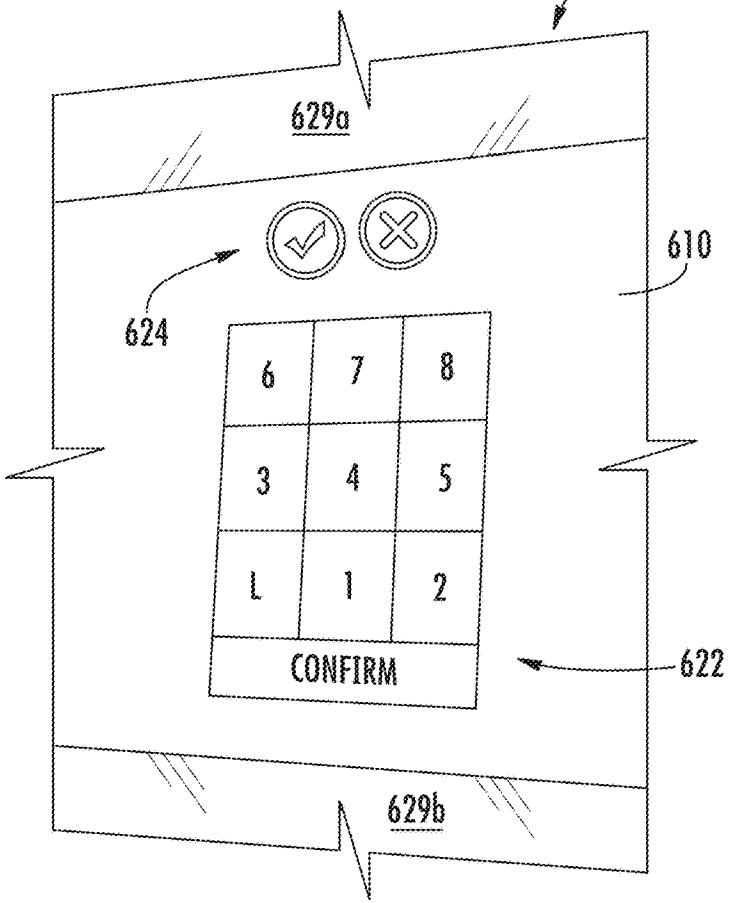
FIG. 6 is a schematic illustration of a display on an interactive surface of an interactive touch-based car operating panel system in accordance with an embodiment of the present disclosure.

Turning now to FIG. 6, a schematic illustration of a display on an interactive surface of an interactive touch-based car operating panel system in accordance with an embodiment of the present disclosure is shown. The interactive touch-based car operating panel system of FIG. 6 includes an interactive element 608 having an interactive surface 610. The interactive element 608 is installed between an upper portion 629*a* and a lower portion 629*b* of an elevator car panel, such as that shown and described above. The interactive surface 610, in the present illustration, includes a displayed entry element 622, such as a keypad or other alphanumeric image that is displayed at one or more locations on the interactive surface 610. As shown, the interactive surface 610 further includes validation, confirmation, and/or cancellation input elements (collectively "confirmation elements 624").

The interactive surface 610, and/or any interactive surface employed in embodiments of the present disclosure, can be a touch-based system that can register input by passengers that touch the interactive surface 610. Various touch-based technologies can be employed without departing from the scope of the present disclosure. For example, the interactive surface 610 can be a capacitive touch (e.g., surface capacitance, projected capacitance, etc.), infrared grid, infrared acrylic projection, optical imaging, dispersive signal technology, acoustic pulse recognition, and/or other type of touch-based technology. In some embodiments, an associated controller can be programmed to map various locations, regions, and/or portions of the interactive surface with specific inputs, and in some embodiments an output (e.g., display image or text) can be overlaid or displayed at the specific location, region, and/or portion having a related input features (e.g., each of the numbers of the displayed entry element 622 is an output).

Figure 7:
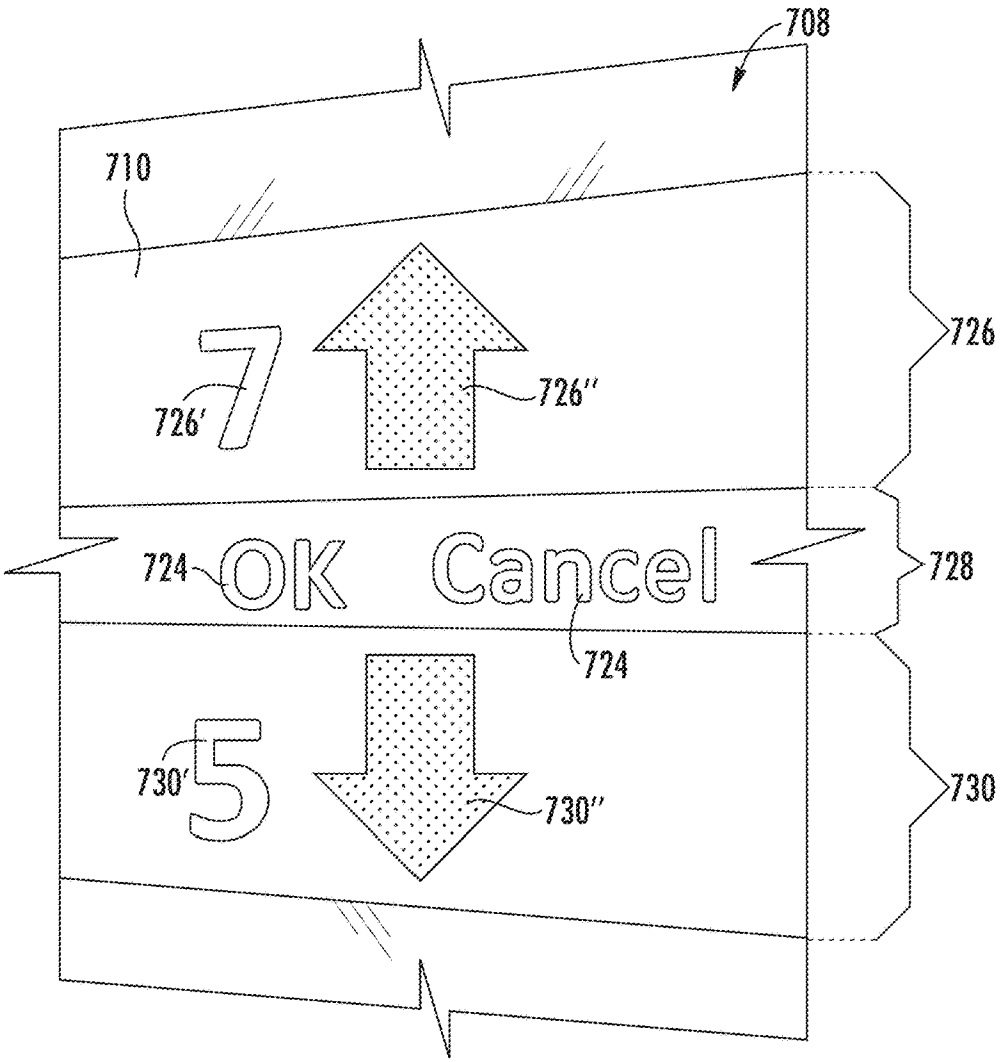
FIG. 7 is a schematic illustration of a display on an interactive surface of an interactive touch-based car operating panel system in accordance with an embodiment of the present disclosure.

Turning now to FIG. 7, a schematic illustration of a display on an interactive surface 710 of an interactive touch-based car operating panel system in accordance with an embodiment of the present disclosure is shown. The interactive surface 710 of this embodiment is divided into input regions having a first input region 726, a second input region 728, and a third input region 730. The input regions 726, 728, 730 are portions of the interactive surface 710 and can be bands, strips, or ribbons that extend an entire length of the interactive element 708 about a periphery of an elevator car. As shown, the various input regions 726, 728, 730 can include various input elements. For example, the first input region 726 includes first region input elements 726', 726". The first region input elements 726', 726" can be used by passengers to indicate an upward travel of the elevator car. For example, in the illustration of FIG. 7, the elevator car may be currently at the $6^{th}$ floor, and the first input region 726 indicates travel upward from the $6^{th}$ floor. Thus, one first region input element 726' displays the number "7" to indicate travel up one floor to the $7^{th}$ floor. The other first region input element 726" is an upward facing arrow that can be interacted with to travel upward. For example, a single push on the first region input element 726" can indicate upward travel by one floor, and pushing the first region input element 726" twice can indicate upward travel by two floors, etc. The input can be duration based instead, such that a preset time period of time indicates upward movement by one floor and double the preset time period indicates upward movement by two floors, etc. Other types of input duration and number may be employed without departing from the scope of the present disclosure. Further, in some embodiments, the first region input element 726" can be used to select a destination floor and the other first region input element 726' is a displayed element that indicates that floor being requested.

The second input region 728 includes confirmation elements 724, which can optionally be provided to enable a passenger to confirm and/or cancel an input request. The third input region 730 includes second region input elements 730', 730" that are similar to the first region input elements 726', 726" but are used for downward movement of the elevator car (e.g., request for a destination floor that is below the current floor).

Figure 8:
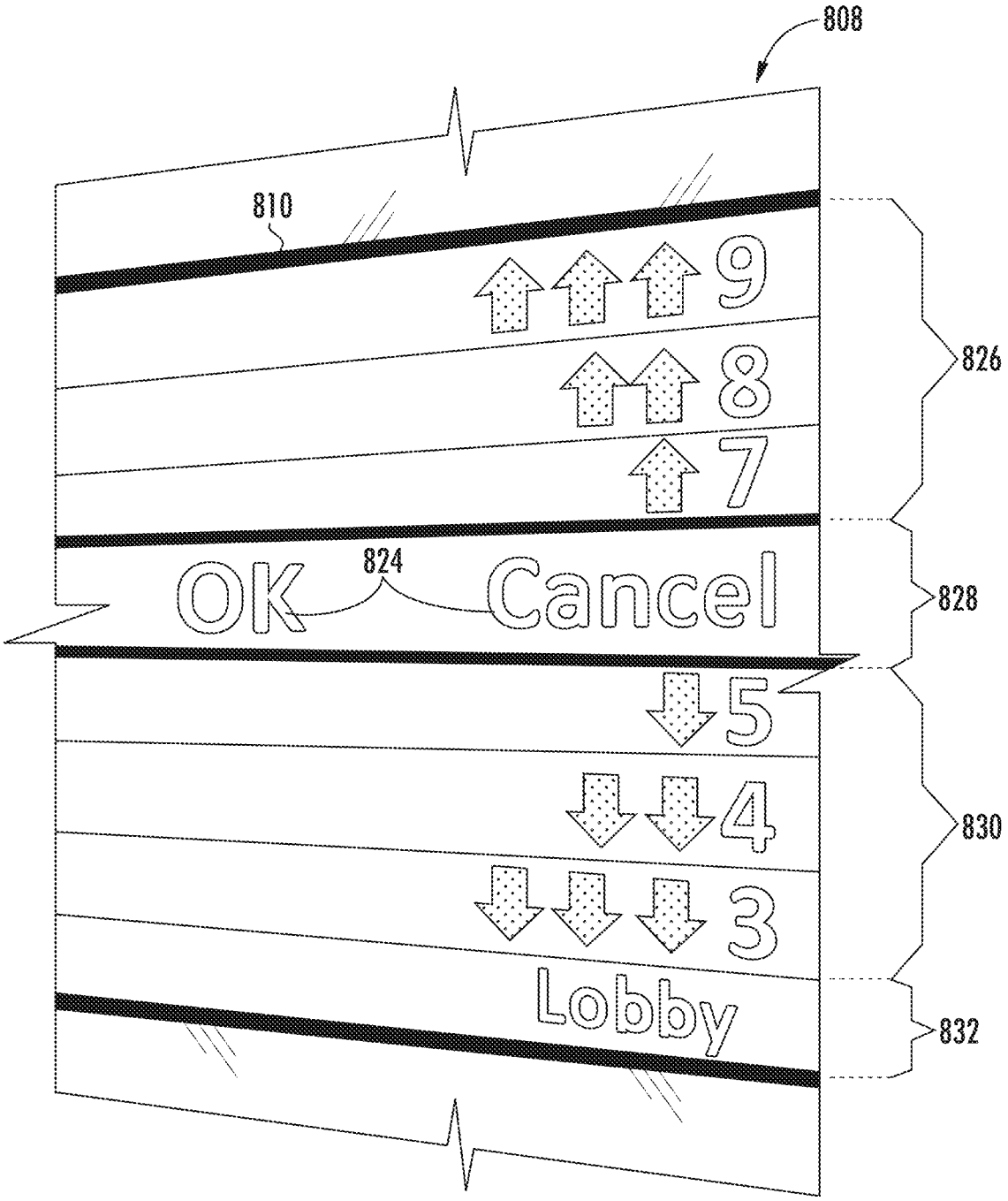
FIG. 8 is a schematic illustration of a display on an interactive surface of an interactive touch-based car operating panel system in accordance with an embodiment of the present disclosure.

Turning now to FIG. 8, a schematic illustration of a display on an interactive surface 810 of an interactive touch-based car operating panel system in accordance with an embodiment of the present disclosure is shown. As shown, the interactive surface 810, of an interactive element 808, of this embodiment is divided into additional input regions having a first input region 826 (which is separated into multiple sub regions), a second input region 828 (having confirmation elements 824), and a third input region 830 (which is separated into multiple sub regions). The input regions 826, 828, 830 are portions of the interactive surface 810 and can include various input elements and/or display elements. For example, as schematically shown, the first input region 826 and the third input region 830 are each separated into multiple sub regions, with each sub region having associated labels, display elements, and/or input elements. The first and third input regions 826, 830 can be used by passengers to make destination requests that are above the current floor (first input region) or below the current floor (third input region). The second input region 828 can include various confirmation/cancellation input features.

Also shown in the embodiment of FIG. 8, a fourth input region 832 is shown. The fourth input region 832 provides quick access destination selection, such as the "Lobby" regardless or independent from a current floor at which the elevator car is located. Thus, a passenger may be able to always and easily select specific, pre-labeled floors as destinations (e.g., lobby, cafeteria, etc.). The fourth input region 832 may be a "quick access element" of the interactive surface 810.

As will be appreciated by those of skill in the art, any number of input regions and/or sub regions can be employed in interactive touch-based car operating panel systems in accordance with embodiments of the present disclosure. The regions/sub regions can be defined by physical or digital separation, as noted above. In the case of digital separation, the regions/sub regions can be programmed and updated and/or changed as needed/desired through a controller or other control unit.

Figure 9:
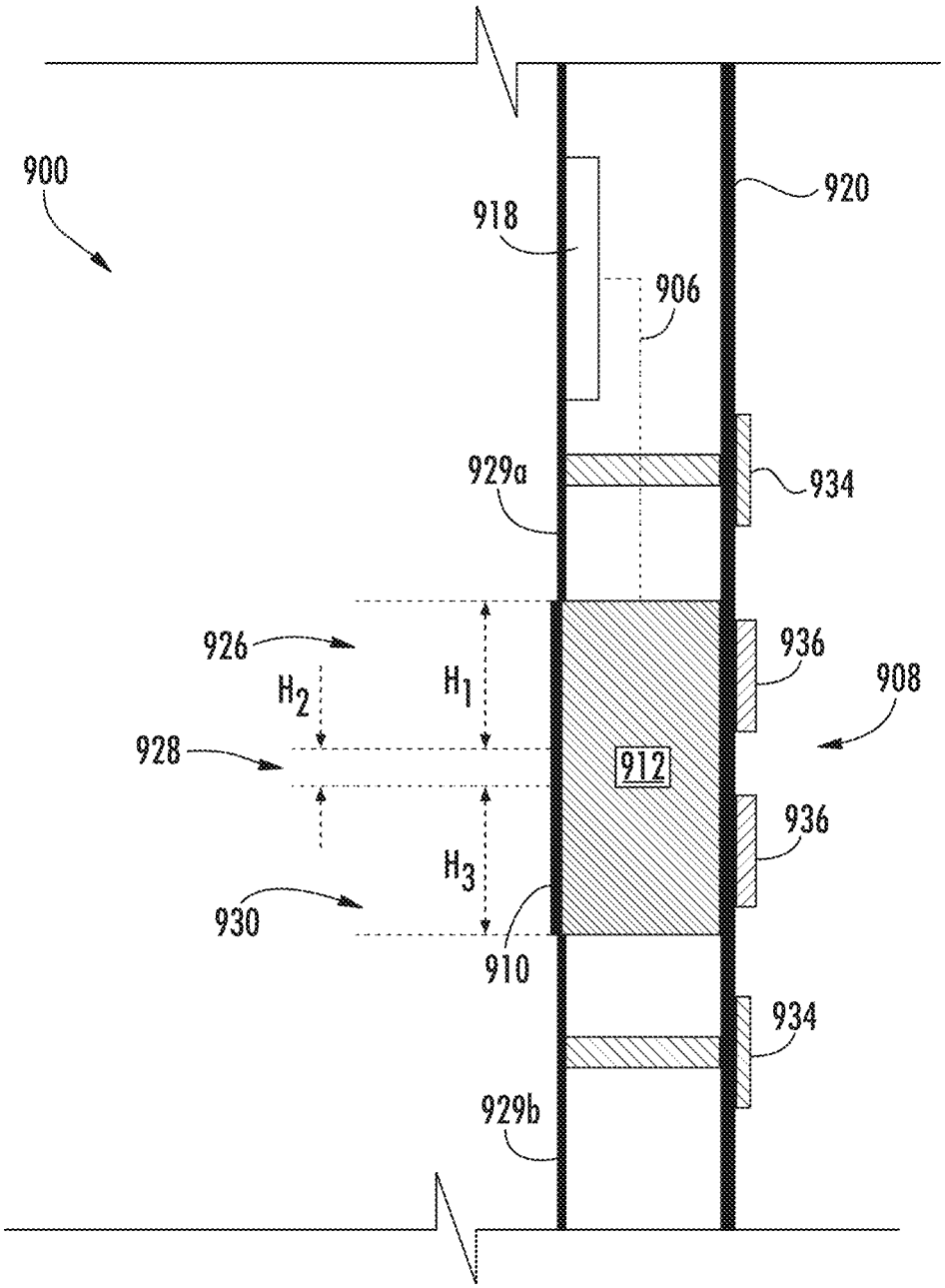
FIG. 9 is a cross-sectional side view of an interactive touch-based car operating panel system in accordance with an embodiment of the present disclosure.

Turning now to FIG. 9, a cross-sectional side view of an interactive touch-based car operating panel system 900 in accordance with an embodiment of the present disclosure is shown. The interactive touch-based car operating panel system 900 is similar to that shown and described above. For example, the interactive touch-based car operating panel system 900 includes an interactive element 908 installed in an elevator car panel between an upper portion 929*a* and a lower portion 929*b* of the elevator car panel. The interactive element 908 has an interactive surface 910 similar to that shown and described above and can extend around a periphery of a passenger compartment of an elevator car. As shown, the upper and lower portions 929*a*, 929*b* of the elevator car panel are mounted to an elevator car wall 920 (e.g., a frame) by one or more panel fasteners 934 (e.g., screws, bolts, etc.) which fixedly retain the upper and lower portions 929*a*, 929*b* to the wall 920. The interactive element 908 is installed between the upper and lower portions 929*a*, 929*b* and can be retained to the wall 920 by interactive element fasteners 936. Although certain fasteners are shown in FIG. 9, various other types of retention, mounting, and/or attaching means or mechanisms may be employed without departing from the scope of the present disclosure. For example, adhesives, mounting between the interactive element 908 and the upper and/or lower portions 929*a*, 929*b* directly, etc. may be employed.

The interactive element 908, as shown, includes a controller 912, which may be electronics or other components as described above. The controller 912 is arranged to control operation (e.g., inputs/outputs) of the interactive element 908. The controller 912 can be configured to divide the interactive surface 910 into various input regions as described above. A single or unitary display may be used for the interactive surface 910 and the various input regions can be defined by software. As shown, a first input region 926 can be assigned a first height $H_1$, a second input region 928 can be assigned a second height $H_2$, and a third input region 930 can be assigned a third height $H_3$. The various heights of the regions can be different from each other, based in part on the functionality assigned or provided by each reference, and as will be appreciated by those of skill in the art in view of the present disclosure. In the embodiment of FIG. 9, the interactive touch-based car operating panel system 900 includes an optional information panel 918 that is in communication with the controller 912 over or through a communication connection 906. The information panel 918 can be mounted to or part of the upper portion 929*a* of the elevator car panel and include a display or screen to output an image or information for use by passengers within an elevator car.

In operation, when an interactive surface of an interactive element is touched by a passenger, an image or other screen may be activated (e.g., touch activates the system). The screen can display arrows (e.g., indicating upward or downward travel) and/or an alphanumeric display (e.g., keyboard, keypad, etc.) to enable a passenger to make an input for a destination for travel. As an example, display arrows may be employed for a small building (e.g., less than six floors) and the alphanumeric display can be used for higher buildings (e.g., six floors or greater). In either arrangement, the passenger can choose a destination floor and (optionally) validate such selection with a validation button.

In some embodiments, if there are several passengers within an elevator car at the same time, the inputs from the passengers can be done simultaneously (e.g., simultaneous processes by one or more controllers). If the requested destination that is input in the interactive touch-based car operating panel system is incorrect, a passenger may be able to use a "cancel" button/input to cancel the improper request.

Advantageously, embodiments of the present disclosure enable an operable car operating panel on each elevator car panel around the interior of an elevator car. Thus, advantageously, passengers in elevator cars so equipped can choose and enter a destination selection from everywhere in the passenger compartment of the elevator car, even if the elevator car is crowded. Further, advantageously, the traditional car operating panel can be suppressed, minimized, or even eliminated entirely. Moreover, advantageously, those of skill in the art will appreciate that because the interactive touch-based car operating panel system in accordance with various embodiments is customizable, the interactive touch-based car operating panel system can be configured to provide decoration or other aesthetics within elevator cars. Additionally, such interactive touch-based car operating panel systems can be used to convey information to passengers within an elevator car.

The use of the terms "a", "an", "the", and similar references in the context of description (especially in the context of the following claims) are to be construed to cover both the singular and the plural, unless otherwise indicated herein or specifically contradicted by context. The modifier "about" used in connection with a quantity is inclusive of the stated value and has the meaning dictated by the context (e.g., it includes the degree of error associated with measurement of the particular quantity). All ranges disclosed herein are inclusive of the endpoints, and the endpoints are independently combinable with each other.

Those of skill in the art will appreciate that various example embodiments are shown and described herein, each having certain features in the particular embodiments, but the present disclosure is not thus limited. That is, features of the various embodiments can be exchanged, altered, or otherwise combined in different combinations without departing from the scope of the present disclosure. Further, additional features and/or components can be incorporated into the easily accessible car operating panels described herein without departing from the scope of the present disclosure.

Advantageously, embodiments described herein provide easily accessible car operating panels such that passengers are not inconvenienced in crowded elevators.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions, combinations, sub-combinations, or equivalent arrangements not heretofore described, but which are commensurate with the scope of the present disclosure. Additionally, while various embodiments of the present disclosure have been described, it is to be understood that aspects of the present disclosure may include only some of the described embodiments.

Accordingly, the present disclosure is not to be seen as limited by the foregoing description, but is only limited by the scope of the appended claims.

What is claimed is:

1. An elevator car comprising:

a plurality of elevator car panels defining a passenger compartment of the elevator car; and an interactive touch-based car operating panel system comprising:

an interactive element extending around at least a portion of a periphery of the passenger compartment and located on at least one of the plurality of elevator car panels, the interactive element having an interactive surface facing the passenger compartment; and a controller arranged to receive passenger input at the interactive surface and control an elevator car in response to the passenger input, wherein the interactive surface is divided into a plurality of input regions, wherein each input region provides a different function, and wherein the plurality of input regions includes a confirmation region enabling confirmation or cancelation of the passenger input.

2. The elevator car of claim 1, wherein the plurality of input regions comprise a first input region and a second input region, wherein the first input region is located relative higher in the elevator car than the second input region and the first input region provides a functionality to request a destination floor above a current floor of the elevator car and the second input region provides a functionality to request a destination floor below a current floor of the elevator car.

3. The elevator car of claim 1, wherein the interactive surface is a display arranged to display interactive elements thereon.

4. The elevator car of claim 1, wherein the interactive surface includes a quick access element to enable selection of a predetermined destination.

5. The elevator car of claim 1, the elevator car further comprising an elevator car door in at least one elevator car panel, wherein the interactive element extends about an entire periphery of the passenger compartment except for where the elevator car door is located.

6. The elevator car of claim 1, the interactive touch-based car operating panel system further comprising an information panel located within the elevator car and controllable to display information related to the passenger input.

7. The elevator car of claim 1, further comprising a primary car operating panel installed in one of the elevator car panels.

8. An elevator car comprising:

a plurality of elevator car panels defining a passenger compartment of the elevator car; and an interactive touch-based car operating panel system comprising:

an interactive element extending around at least a portion of a periphery of the passenger compartment and located on at least one of the plurality of elevator car panels, the interactive element having an interactive surface facing the passenger compartment; and a controller arranged to receive passenger input at the interactive surface and control an elevator car in response to the passenger input, wherein the interactive surface is divided into a plurality of input regions, wherein each input region provides a different function, and wherein the plurality of input regions comprise a first input region and a second input region, wherein the first input region is located relative higher in the elevator car than the second input region and the first input region provides a functionality to request a destination floor above a current floor of the elevator car and the second input region provides a functionality to request a destination floor below a current floor of the elevator car.

9. The elevator car of claim 8, wherein the interactive surface is a display arranged to display interactive elements thereon.

10. The elevator car of claim 8, wherein the interactive surface includes a quick access element to enable selection of a predetermined destination.

11. The elevator car of claim 8, the elevator car further comprising an elevator car door in at least one elevator car panel, wherein the interactive element extends about an entire periphery of the passenger compartment except for where the elevator car door is located.

12. The elevator car of claim 8, the interactive touch-based car operating panel system further comprising an information panel located within the elevator car and controllable to display information related to the passenger input.

13. The elevator car of claim 8, further comprising a primary car operating panel installed in one of the elevator car panels.

14. An elevator car comprising:

a plurality of elevator car panels defining a passenger compartment of the elevator car;

an elevator car door in at least one of the elevator car panels;

an interactive touch-based car operating panel system comprising:

an interactive element extending around at least a portion of a periphery of the passenger compartment and located on at least one of the plurality of elevator car panels, the interactive element having an interactive surface facing the passenger compartment; and a controller arranged to receive passenger input at the interactive surface and control an elevator car in response to the passenger input, wherein the interactive element extends about an entire periphery of the passenger compartment except for where the elevator car door is located, and the interactive surface is configured to use at least one of capacitive touch, infrared grid, infrared acrylic projection, optical imaging, dispersive signal technology, and acoustic pulse recognition.

15. The elevator car of claim 14, wherein the interactive surface is a display arranged to display interactive elements thereon.

16. The elevator car of claim 14, wherein the interactive surface includes a quick access element to enable selection of a predetermined destination.

17. The elevator car of claim 14, the interactive touch-based car operating panel system further comprising an information panel located within the elevator car and controllable to display information related to the passenger input.

18. The elevator car of claim 14, further comprising a primary car operating panel installed in one of the elevator car panels.

19. The elevator car of claim 14, wherein the interactive surface is divided into a plurality of input regions, wherein each input region provides a different function.

20. The elevator car of claim 19, wherein at least one of:

the plurality of input regions includes a confirmation region enabling confirmation or cancelation of the passenger input; and the plurality of input regions comprise a first input region and a second input region, wherein the first input region is located relative higher in the elevator car than the second input region and the first input region provides a functionality to request a destination floor above a current floor of the elevator car and the second input region provides a functionality to request a destination floor below a current floor of the elevator car.

* * * * *